United States Patent [19]

Crisman et al.

[11] 4,299,100

[45] Nov. 10, 1981

[54] REFRIGERATABLE BEVERAGE CONTAINER HOLDER

[75] Inventors: Thomas L. Crisman; Stanley R. Moore; Harry R. Weaver, all of Dallas, Tex.

[73] Assignee: Freezesleeves of America, Inc., Dallas, Tex.

[21] Appl. No.: 133,452

[22] Filed: Mar. 24, 1980

[51] Int. Cl.[3] ..... F25D 3/08

[52] U.S. Cl. ..... 62/457; 220/428

[58] Field of Search ..... 220/428, 427, 408, 410, 220/413, 464, 468; 62/457

[56] References Cited

U.S. PATENT DOCUMENTS

| | | | |
|---|---|---|---|
| 2,711,766 | 6/1955 | Archer et al. | 220/468 X |
| 3,205,678 | 9/1965 | Stoner | 62/457 |
| 3,302,428 | 2/1967 | Stoner et al. | 62/457 |
| 3,360,957 | 1/1968 | Paquin | 62/457 |
| 3,765,559 | 10/1973 | Sauey et al. | 62/457 X |
| 4,163,374 | 8/1979 | Moore et al. | 62/457 |

*Primary Examiner*—Lloyd L. King

*Attorney, Agent, or Firm*—Stanley R. Moore; Thomas L. Crisman

[57] ABSTRACT

An improved beverage container holder manufactured by a process including the steps of providing a cylindrical outer cup of foam material and press fitting a cylindrical inner cup within the outer cup after filling the annulus formed therebetween with a refreezable fluid. The cylindrical inner cup includes a radially extending flanged region at the open end which comprises an inwardly and downwardly tapered rib circumferentially disposed about the cup for engaging and becoming embedded within the side walls of the cylindrical outer cup to form a cylindrical seal therearound. A resilient outer ring means is snapped over the juncture between the respective open ends of the inner and outer cup to secure the seal therebetween. The refreezable fluid contained therein is preferably bled of excess pressure imparted during the assembly insertion of the inner cup into the fluid containing outer cup by squeezing an intermediate portion of the assembled cup configuration to force excess fluid and/or air through the interface between the inner and outer cup juncture prior to receiving the outer ring thereover. In this manner, excess pressure is not retained within the assembled structure.

10 Claims, 5 Drawing Figures

REFRIGERATABLE BEVERAGE CONTAINER HOLDER

BACKGROUND OF THE INVENTION

1. Field of the Invention

One aspect of the invention relates to a method of assembling a refrigeratable beverage container holder and, more particularly, to a method of manufacturing a beverage container holder having an inner cup press fitted into an outer foam cup wherein the annulus therebetween is filled with refreeezable fluid. Another aspect of the invention comprises an improved beverage container holder having an outer foam cup and an inner cup which includes a radially extending flange slightly larger in diameter than the inner foam cup having an inwardly and downwardly extending edge which may be tightly interference fitted within the foam cup inner walls.

2. History of the Prior Art

It is conventionally desirable to consume most beverages such as soft drinks and particularly beer in a chilled state. Containers of such beverages are thus stored in refrigerated areas such as refrigerators, ice boxes or ice chests for sufficient periods of time prior to consumption to lower the temperature. Beverages such as soft drinks are often emptied from their containers into glasses or cups filled with ice to afford maximum chilling during consumption. The taste of most soft drinks is not rendered totally unpalatable by diluting water produced by the melting ice; however, ice cannot be added to beer or ale due to the watering effect and the undesirable taste resulting therefrom. For this reason, beer is usually stored in refrigerators where the temperature is relatively low. Additionally, other means have been used such as placing the beverage in very thin, highly thermally conductive aluminum and steel walled cans to enhance the rate and extend to which a beverage may be cooled from an ambient temperature. Unfortunately, conventional refrigerators are not always kept at a temperature whereby the beverage is suitably chilled, regardless of its container, to a point near that of freezing. Unless the consumer wishes to place the beverage can or bottle in the refrigerator freezer to suitably chill it, a beverage such as beer is normally served "cool" but not "chilled". But neither beer nor soft drinks can be left in the freezer unattended since both would eventually freeze. For this reason, beer and many soft drinks are consumed directly from their containers in a less than desirable, partially chilled state.

The desirability of consuming beverages in as nearly a chilled state as possible has prompted the development of apparatus to insulate a chilled beverage container from the environment during consumption of the beverage. One such device of contemporary popularity is a beverage can holder comprised of a suitable foam material such as expanded polystyrene molded into an insulative cup configuration suitable for receiving a beverage can therein. Usually, a plastic ring is provided at the top of the insulative cup whereby the beverage can is disposed centrally therein with a dead air space therearound. The combination of the foam insulation characteristics and dead air space comprise a suitable means for maintaining the chilled condition of the beverage for some extended period of time. Such insulative cups, or beverage holders, are especially popular out of doors where an uninsulated beverage container will quickly absorb heat from the environment.

Certain problems exist with the aforesaid prior art "dead air" beverage holders. The beverage must initially be chilled. Once the beverage container is removed from its chilling environment it can only get warmer, and the insulated beverage container only retards this inevitable result. Aggravating the warming trend is the fact that the conventional beverage containers which are quickest to chill, i.e. those made of thin walled thermally conductive metal, are also the quickest to get warm. Beverages in glass containers warm somewhat slower in an ambient temperatured environment than aluminum, but not much. It may thus be seen that most all container materials have a relatively high rate of thermal conductivity to permit rapid cooling of the beverage in a refrigerator but which also operates to afford rapid heat absorption into the beverage once the container has been removed into an ambient temperature environment for consumption. It is therefore desirable to provide a low cost beverage holder which overcomes the aforesaid problems wherein a beverage in its original container can be consumed over an extended period of time at a constant and desirably chilled or cold temperature.

The prior art has provided refrigeratable beverage holders in various embodiments; however, such known embodiments are heavy, cumbersome, relatively expensive mug or stein-like devices. For example, one such device is shown and described in U.S. Pat. No. 3,302,428, issued on Feb. 7, 1977, therein illustrating a mug-shaped device for keeping cool a beverage in a container. The device of that invention is designed to receive beverage containers of various diameters and provides spring means for securing a snug contact with the walls of various sized beverage containers and although somewhat effective in cooling said beverages, is relatively expensive, heavy, cumbersome, bulky and mechanically complicated in comparison with conventional foam "dead air" beverage can holders.

An additional prior art refrigeratable beverage container holder comprising a considerable advancement over the aforesaid prior art embodiments is that shown and described in U.S. Pat. No. 4,163,374 to Moore et al and assigned to the assignee of the present invention. The container holder of Moore et al comprises a foam outer cup which receives a plastic inner cup therein and a freezable refrigerant fluid therebetween. It is important to note that the structure shown and described by Moore et al be assembled in various conventional manners; however, it is most advantageously manufactured in accordance with the improved inner cup structure and method of manufacture set forth in the present application. The improved inner cup structure of the present invention comprises a radially extending circumferentially disposed flange portion being embedded in the foam material of the outer cup to assist in sealing the region between the inner and outer cups with the tongue portion. During insertion of the inner cup into the outer cup a compression effect is created much as the same as a piston reciprocating within a cylinder. To compensate for the compression of fluid within the annulus formed between the inner and outer cups the elastomeric properties of the outer cup permit its complemental expansion to accommodate the increased volume of liquid and gas. This increase or expansion, may or may not be visually perceptible initially, but proper sealing of the juncture between the inner and outer cups and achieving a stable internal pressure make it preferable to release this compression prior to receiving the layover of the outer ring. In this manner, the outer cup is permitted to return to its original unstressed, unexpanded, condition prior to packaging and use.

The present invention provides an inner cup structure having a radially extending flange of a diameter slightly greater than the inside diameter of the foam outer cup. The radially extending flange includes a sharp peripheral edge for being embedded into the inner wall of the foam cup and an inwardly and downwardly tapering conical region for ease of press fit insertion into the foam outer cup.

The method of the present invention is especially adapted for assembling the inner cup into the foam outer cup of the aforesaid Moore et al patent by providing a process of pressure equalization and insertion support during the assembly steps. The bottom face of the outer cup is supported by a disc member prior to insertion of the inner cup and, once the inner cup is inserted into the outer cup, the compressed fluid and air is vented or "burped". Burping is performed by the application of an intermediate flexing force to the side wall of the outer cup applied in such a manner as to cause relative movement between the outer cup and inner cup across the juncture of the sealed juncture. It is preferable to perform the burping operation manually by utilizing two hands. One hand may be used to squeeze or pinch the upper portion of the outer cup to form an area of reduced stress upon the inner cup while the lower portion of the outer cup is squeezed to effect the "burping" of the compressed fluid therein. It is also preferable to fill the annulus of the inner and outer cup with no more fluid than is necessary wherein a small air gap is created prior to burping. In this manner air is released during the burping operation rather than fluid which reduces the cost of cleaning the assembled unit prior to packaging.

SUMMARY OF THE INVENTION

The invention relates to a low cost assembly method for manufacture of a refrigeratable beverage container holder and a structure adapted for ease of manufacture. More particularly, one aspect of the invention involves providing an outer foam cup, a cylindrical inner cup having a radially extending flange region at the open end for positioning adjacent the open end of the outer cup to form a line of juncture therebetween. An outer ring encloses the line of juncture between the respective open end of the inner and outer cups. A refreezable fluid is received within the space between the inner and outer walls of the respective cups. The method comprises filling the outer cup with the select volume of refreezable gel and then inserting the inner cup axially into the outer cup to force the gel between the side walls of the inner and outer cups with the annulus therebetween. The radially extending flanged region is then embedded into the inner walls of the outer cup and the layover outer ring is snapped thereover to compress and seal the juncture of the radial flange and the inner wall of the foam cup.

Another embodiment of the present invention, the assembled inner and outer cup configuration is vented by the application of intermediate laterally contracted force about the outer cup for forcing excess gel upwardly through the juncture between the radial flange of the inner cup and the inner wall of the outer cup prior to receiving the layover outer ring means thereover. A more specific embodiment of this process in this step is effected manually by a single operator positioning one hand in an intermediate portion of the outer cup and his second hand in the upper most region of the outer cup wherein the second hand squeezes the upper outer portion of the outer cup to reduce the compression against the inner cup flange therearound while squeezing the first end to expell gel and/or entrapped gases through the juncture formed between the inner cup and the outer cup at the point of squeezing. The outer cup is allowed to reduce its compressed expansion as the pressure of the fluid contained in the annulus between the inner cup and outer cup is permitted to substantially equalize to that of the atmosphere around the assembly. In this manner, the effects of freezing and/or expansion of the gel in the annulus area is minimized. In another embodiment of the present invention the gel is injected into the outer cup through a reciprocal piston means which injects a select volume of gel into the lower portion of the outer cup prior to receiving the inner cup. The volume of gel is substantially equivalent to, and preferably slightly less than, the annular volume between the outer cup and inner cup after said assembly is vented to atmospheric pressure. In this manner, excess gel is not vented through the exhausting or venting of the assembly during that particular assembly step.

In another aspect of the invention, a reciprocating cylinder is utilized as a mandril for receiving an inner cup thereupon which mandril is adapted for vertical movement substantially an axial alignment with an outer cup positioned thereunder. The seating of the inner cup within the outer cup is carefully maintained in an axially oriented configuration.

In another embodiment of the present invention the outer ring comprises a thermoplastic member which is adapted for securely engaging the outer cup therearound. The step of snapping a ring over the subassembly is further inclusive of the step of heating the outer ring to soften the thermoplastic and render it more elastic as the outer ring is laid over the inner and outer cup subassembly. Thus, damage or deformation of the foam outer cup is minimized during assembly and the subsequent cooling, and resultant contraction, of the outer ring further provides an improved seal between the outer cup and the flanged region of the inner cup.

In another embodiment of the present invention the outer cup is first coated with a water vapor impervious material which coats the inner surface of the outer cup to prevent the evaporation of the water base of the gelatinous material. This coating operation may be done automatically or manually, for example, by pouring a liquid plastic into the outer cups, sloshing the walls, pouring the fluid back out and permitting the outer cups to drain in an upside down position.

BRIEF DESCRIPTION OF THE DRAWINGS

For a more complete understanding of the present invention, and for further objects and advantages thereof, reference may be now had to the following description taken in conjunction with the accompanying drawing in which.

DETAILED DESCRIPTION

Figure 1:
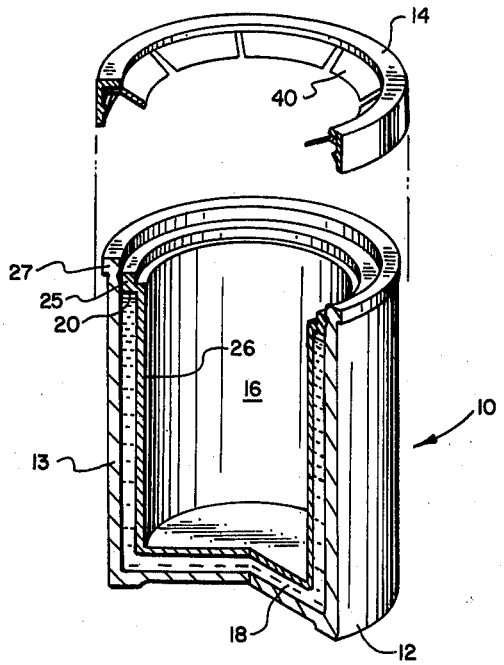
FIG. 1 is a partially exploded, cross sectional, perspective view of one embodiment of the present invention.

Referring first to FIG. 1 there is shown a partially exploded, cross-sectional perspective view of the assembled holder 10 of the present invention, wherein the liner 16 has been seated centrally within the foam cup 12. A ring 14 is disposed thereabove to further secure the assembled configuration which includes a refrigerant 18 disposed between the housing walls 13 and the liner 16. A small annular "dead air" space 20 may be left above the refrigerant 18 to allow for the expansion thereof during its solidification from a fluid state, however, most of the volumetric expansion of a water based fluid refrigerant upon freezing is compensated for by the resilient walls of the styrofoam outer cup 12. The cup shaped liner 16 (hereinafter sometimes referred to as the inner cup 16) includes a radially extending flange 25 at its upper, open end for positioning near top edge 27 of the cup 12 (hereinafter sometimes referred to as the outer cup 12). The flange 25 includes an outer cylindrical wall 22 preferably of a diameter the same as or slightly greater than the diameter of the upper edges of the inside walls 28 of the outer cup 12. In this configuration, the outer cylindrical wall region 22 is lightly press fitted into the outer cup 12 during assembly to centrally align it therein while substantially sealing it therearound. The term press fit is used herein to refer to interference engagement between respective press fit surfaces.

Figure 3:
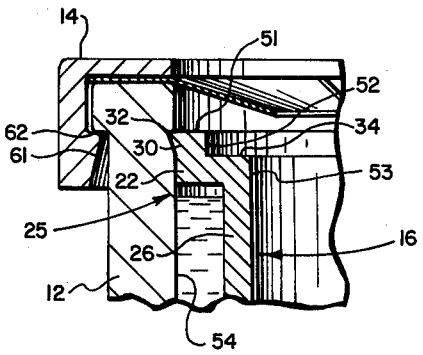
FIG. 3 is an enlarged, fragmentary cross sectional view of an upper portion of the apparatus of FIG. 1.

Referring to FIG. 3, there is shown a detail fragmentary cross-section view which illustrates how the various elements of the assembly of the invention cooperate to effect a seal between the radial flange of the inner cup 16 and the inner wall of the outer foam cup 12. A flange 25 extends radially outward from the cylindrical body 26 of the inner cup 16. The flange includes a generally cylindrical outer wall portion 22 extending parallel to the walls of the inner and outer cups. The diameter of the cylindrical outer wall portion 22 is about the same as the inner diameter of the outer cup. The cylindrical portion is intersected by an upwardly and outwardly extending conical ramp region 30 which terminates at a short upper and outer edge 32. The top 51 of the flange is flat and intersects a vertically extending cylindrical region 52 connected to another flat portion 34 which connects to the inner wall 53 of the inner cup 16. The diameter of the sharp outer edge 32 is larger than the inner wall 54 of the outer cup 12 so that when the inner cup is fully positioned, the edge 32 "digs into" the inner wall 54 and seals the juncture. An interference between ten and forty thousandths of an inch has been shown to be satisfactory for centering and sealing such an assembly.

When the outer ring 14 is snapped into place it completes the seal. The inner cylindrical wall 61 of the ring 14 includes an inwardly protruding circular ridge 62 which extends around the entire inside circumference of the ring 14. The ridge 62 is positioned in general alignment with the sharp outer edge 32 of the inner cup 16 where it is positioned against the inside wall 54 of the outer cup 12. The ridge 62 is positioned against the outside wall of the outer cup 12 to produce an additional radially inwardly directed force thereagainst and further seal the juncture between the inner and outer cups.

Figure 2:
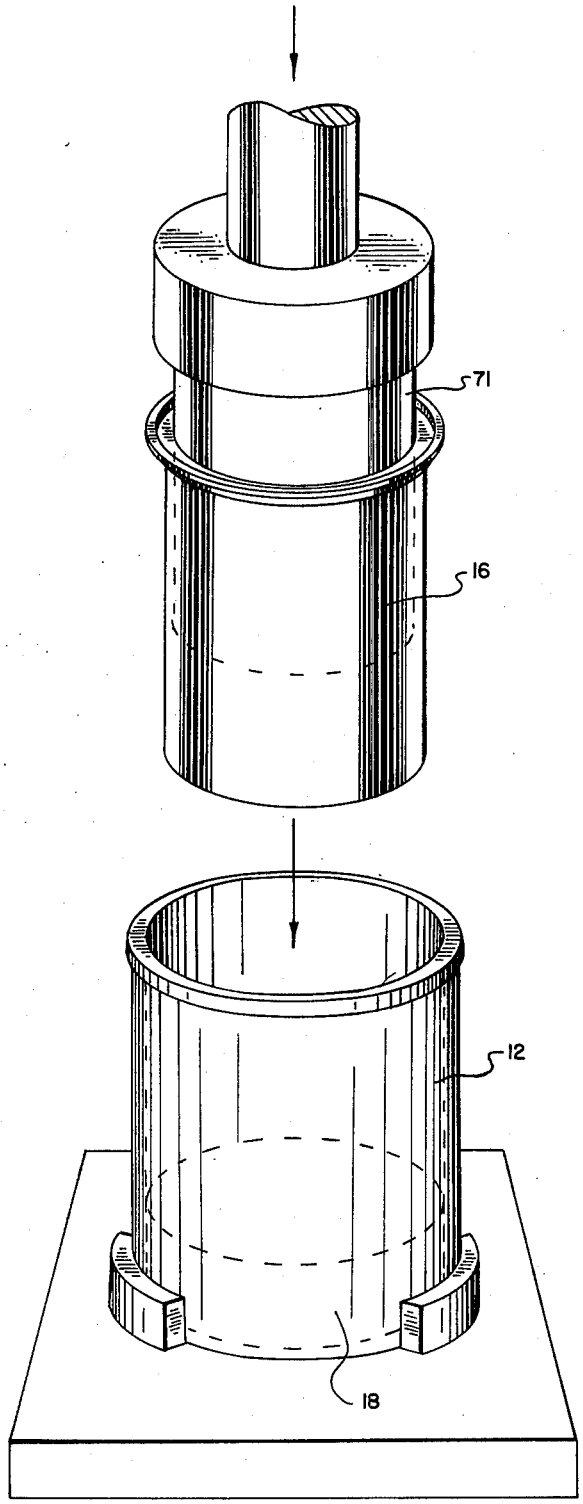
FIG. 2 is a perspective view of one step of the assembly of the apparatus of FIG. 1.

In FIG. 2 the inner cup 16 is shown being inserted into the outer cup 12. The outer cup 12 is positioned laterally in axial alignment with a mandril 71 adapted for reciprocal movement to insert the inner cup 16 therein to a predefined depth within the outer cup 12. A precise amount of gel 18 is provided within the outer cup 12 so that the small volume of air is retained within the annulus prior to "burbing", as will be described below.

During insertion as shown in FIG. 2, the ramp 30 serves as an expansion and guide member to: (1) center the inner cup 16 within the outer cup 12; (2) expand the outer cup 12 as the inner cup 16 is moved axially relative thereto; and; (3) become embedded into the compliant inner walls of the foam outer cup once press fit insertion has been completed. The angle of the frustroconical ramp 30 is approximately 45 degrees with the axis of the cups which provides sufficient inclination for expansion of the outer cup 12. Because the outer cup 12 is a foam material it elastically expands to receive the sharp circumferential edge 32 and only upon termination of the downward movement of the inner cup relative to the outer cup does the elastic stress cause the outer cup wall to compliantly receive the sharp edge 32 of the inner cup to seal the fluid containing annular space. Once assembled into this configuration the outer ring 14 is received over the inner and outer cup line of juncture. The unstressed diameter of the elastic outer ring 14 is preferably slightly less than the outer diameter of the outer cup so that, in position the ring applies a radially inwardly directed force to the upper edge of the outer cup and further embed the ramp tongue into the inner wall of the outer cup. The outer ring 14 plastically deforms the outer cup around the ramp edge 32 to further secure the juncture between the edge 32 and the inner wall of the foam cup. This combination of elastic and plastic deformation of the outer cup across the line of juncture between the edge 32 and inner wall of the outer cup and the outer ring produces a fluid-tight seal. The elastomeric property of the foam outer cup facilitates the seal. A coating applied to the inner wall of the outer cup which will be further discussed below, is pierced along the line of juncture and does not interfere with the sealing of the inner and outer cups.

It has been found that only through substantially true axial alignment between the inner and outer cups will the assembly reliably function. Misalignment between the inner and outer cup causes variations in the fluid thickness around the inner cup. During freezing, the gel expands and unequal gel thickness around the cup imparts unequal forces to both the inner and outer cups. This uneven expansion is very detrimental to the outer cup which has been observed to crack when misalignment exists. Once a sufficient thickness of gel has accumulated on one side of the cup, the unequal force of expansion can cause an expansion of the outer cup beyond its elastic limit causing the crack. It is thus important to properly align the assembly as set forth in the following description.

The inner cup is positioned within the outer cup after the outer cup has received a premeasured volume of fluid. The inner cup is first prepressed into the outer cup a sufficient distance along the conical ramp regin 30 wherein said tongue is preliminarily secured about the opening of the outer cup. This preassembly condition permits handling of the inner/outer cup subassembly for movement to the "pressing and burping" station. The subassembly is next stored or moved directly to the burping station wherein a mandrill is inserted into the inner cup. The outer cup is then preferably rotated or rocked from the underneath portion to achieve axial alignment between the inner and outer cup across the ramped tongue portion. Once properly aligned, the inner cup is then forced down into the outer cup in a rectilinear fashion to form the inner and outer cup into a full assembled configuration. "Burping" may be performed by squeezing the outer cup preferably along the line of juncture to permit the compressed gel to be expelled around the ramped portion. That is, "burping" is performed by the application of an intermediate flexing force to the side wall of the outer cup applied in such a manner as to cause relative movement between the outer cup and inner cup and form a small gap across the sealed juncture. It is preferable to perform the burping operation manually by utilizing two hands. One hand may be used to squeeze or pinch the upper portion of the outer cup to form an area of reduced stress upon the inner cup while the lower portion of the outer cup is squeezed to effect the "burping" of the compressed fluid therein. It may be seen that the combination of the frustroconical ramp and the elastomeric properties of the outer cup facilitates the expelling of both air and fluids from the annulus between said inner and outer cups.

The inner surface of the outer cup is coated to seal the pores of the expanded bead polystyrene, or other foam, outer cup prior to assembly. The application of a suitable water vapor impervious coating has been shown to sufficiently seal the inner surfaces of the outer cup walls to prevent the passage of fluid and substantially impair the transmission of water vapor from the gel after the assembly process has been completed. Application of the coating may be achieved simply by pouring a volume of liquid coating material from one cup to another or in more elaborate ways. Once a cup has been filled to the brim with coating and then the coating poured out, the cup is placed in an inverted position to dry. Excess coating drips out and is recollected in a secondary recovery trough for reuse in coating other cups. It has been shown that the application of lightly circulating air beneath a vented support grid facilitates the drying of the outer cup. The coating may be dryed in a period of about 15 to 25 minutes. It generally takes between 30 seconds and 90 seconds for a cup to substantially drip free of excess coating. Outer cups once coated are then restacked for filling with fluid.

Figure 4:
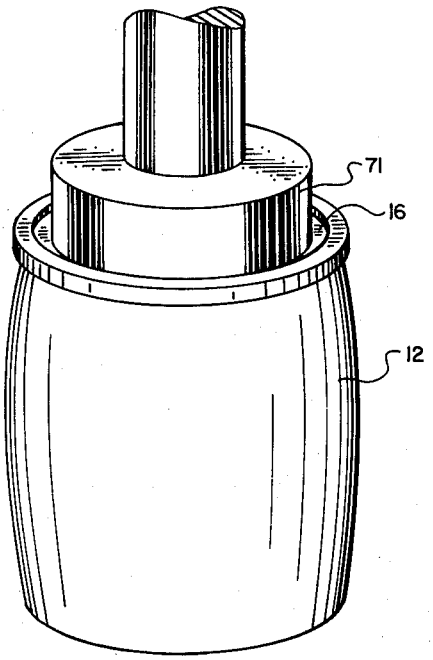
FIG. 4 is a perspective view of another step of the assembly of the apparatus of FIG. 1.

FIG. 4 is an exaggerated perspective view of the assembled inner cup 16 and outer cup 12 prior to receiving the ring thereover wherein it is shown the outer cup 12 has expanded under the compression of fluid within the annulus. This compression is obviously exaggerated for purposes of illustration. The expansion of the outer cup is illustrative of the characteristics of the elastic foam outer cup as previously shown and described and claimed in the Moore et al patent. This elastic characteristic of the outer cup 12 facilitates thermal expansion of the ice during freezing of the refreezeable gel. During the insertion assembly step of FIG. 4, it should be pointed out that a disc is received beneath the outer cup recessed bottom portion as best illustrated in FIG. 1. This recessed bottom portion is the conventional method of fabricating such expanded bead polystyrene outer cups and does require special handling in order to prevent a concave expansion of that portion during the assembly as it is shown in FIG. 4.

Figure 5:
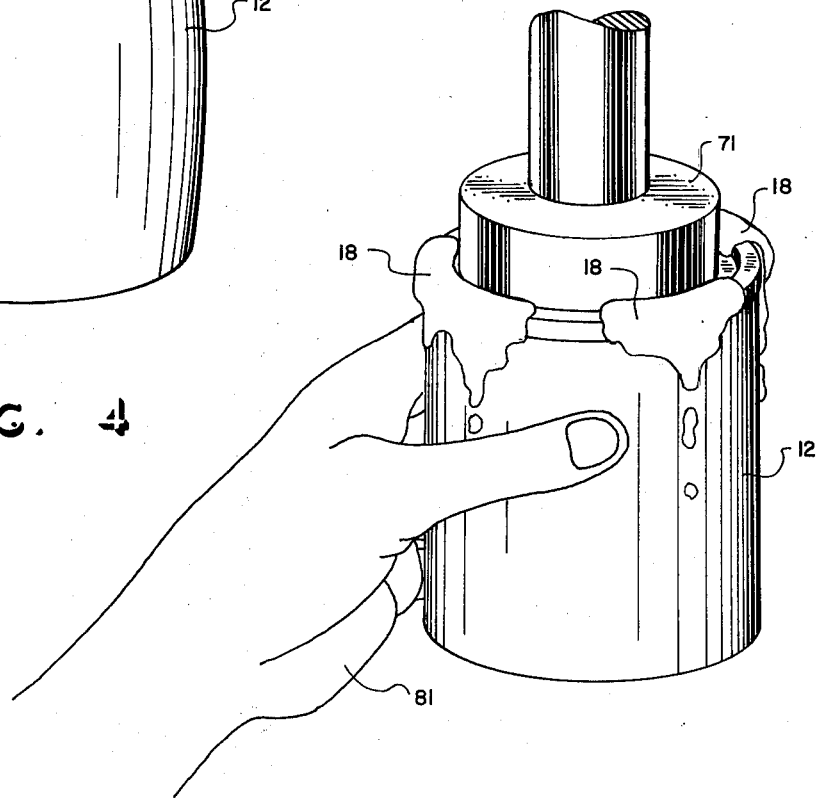
FIG. 5 is a perspective view of another step of the assembly of the apparatus of FIG. 1.

FIG. 5 illustrates the application of an operator's hand 81 in the intermediate portion of the outer cup and the squeezing and/or application of lateral pressure has caused the pressure of the fluid in the annulus to exceed any tension force across the juncture of the inner and outer cups to allow expulsion of excess gel. In the preferred embodiment, excess gel would not be expelled due to the fact that a small volume of air would be trapped along with the fluid gel. In a preferred embodiment it should be noted that a second hand may be used to squeeze the upper portion of the outer cup along the line of juncture to form a gap in conjunction with squeezing the intermediate portion thereof to permit the expulsion of and or venting of gas and/or gel at a precise point rather than at random points around the cup.

It is thus believed that the operation and construction of the present invention will be apparent from the foregoing description. While the method and apparatus shown and described has been characterized as being preferred it will be obvious that various changes and modifications may be made therein without departing from the spirit and scope of the invention as defined in the following claims.

We claim:

1. An improved refrigerated holder for a beverage container of the type including a cylindrical outer cup of insulative foam material closed on one end and open on the other, a cylindrical inner cup positioned within said outer cup with a height less than that of the outer cup, an outer diameter less than the inner diameter of the outer cup to define an annular space therebetween and an inner diameter for receiving the cylindrical walls of a beverage container therein, said inner cup also including a radially extending flange at the open end for positioning near the open end of the outer cup to close the annular space, and a freezeable fluid positioned within the annular space between the inner walls of the outer cup and the outer walls of the inner cup for absorbing heat from the walls of a beverage container positioned within the inner cup when the fluid is frozen to cool the beverage within the container; the improvement comprising:

a sharp circumferential edge region formed on the outer periphery of the radially extending flange of the inner cup having a diameter greater than that of the inner diameter of the outer cup to be embedded in the foam wall of the outer cup and effect a sealing of the annular fluid containing space.

2. An improved refrigerated holder for a beverage container as set forth in claim 1 which also includes:

a circular elastic retaining ring having an unstressed diameter slightly less than that of the outer cup positioned about the open end of the outer cup to apply a radially inward force to said outer cup walls and securely embed the sharp circumferential edge of the inner cup radial flange into the inner walls of the outer cup and reinforce the sealing engagement therebetween.

3. An improved refrigerated holder for a beverage container as set forth in claim 2 wherein said circular elastic retaining ring includes a radially inwardly protruding circular ridge positioned in general alignment with the sharp outer edge of the inner cup radial flange to assist in sealing the juncture between the inner and outer cups.

4. An improved refrigerated holder for a beverage container as set forth in claim 1 wherein the radially extending flange of the inner cup also includes a frustroconical ramp portion extending inwardly and downwardly from the upper and outer sharp peripheral edge to facilitate relative axial movement between the inner and outer cups during insertion of the inner cup down into the outer cup.

5. An improved refrigerated holder for a beverage container as set forth in claim 1 wherein the outer cup is formed of expanded bead polystryene foam.

6. A holder for cooling a beverage container during consumption:

a cylindrical outer cup of foam material having an open and a closed end, said foam being thermally insulative for comfortable handling and elastically resilient for compliance with the physical expansion of a freezeable fluid contained thereby upon freezing of said fluid;

a cylindrical inner cup positioned within said outer cup, said inner cup being shorter in height than the outer cup, having an outer diameter less than the inner diameter of the outer cup to define an annular space therebetween and an inner diameter for receiving the cylindrical walls of a beverage container, said inner cup also including a radially extending flange region having a diameter greater than the inner diameter of the outer cup and a sharp circumferential edge embedded in the complaint inner wall of the outer cup to effect a closure seal of said annular space; and a freezeable fluid within the annular space between the outer walls of the inner cup and the inner walls of the outer cup for, upon first being frozen, then absorbing heat through the walls of the inner cup from a beverage container positioned within the inner cup and thereby cool the beverage.

7. A holder for cooling a beverge container during consumption as set forth in claim 6 which also includes:

a circular elastic retaining ring having an unstressed diameter slightly less than that of the outer cup positioned about the open end of the outer cup to apply a radially inward force to said outer cup walls and securely embed the sharp circumferential edge of the inner cup radial flange into the inner walls of the outer cup.

8. A holder for cooling a beverage container suring consumption as set forth in claim 6 wherein said radially extending flange of the inner cup also includes a frustroconical ramp portion extending inwardly and downwardly from the upper and outer sharp peripheral edge to facilitate relative axial movement between the inner and outer cups during insertion of the inner cup down into the outer cup.

9. A holder for cooling a beverage container during consumption as set forth in claim 7 wherein said circular elastic retaining ring includes a radially inwardly protruding circular ridge positioned in general alignment with the sharp outer edge of the inner cup radial flange to assist in sealing the juncture between the inner and outer cups.

10. A holder for cooling a beverage container during consumption as set forth in claim 6 wherein the outer cup is formed of expanded bead polystyrene.

* * * * *